US009376858B2

(12) United States Patent
Grun

(10) Patent No.: US 9,376,858 B2
(45) Date of Patent: Jun. 28, 2016

(54) DEVICE COMPRISING PROTECTIVE NETTING, SUITABLE FOR USE AS A BARRIER FOR ANY TYPE OF OPENING LOCATED AT A HEIGHT

(71) Applicant: Andrea Luisa Grun, Buenos Aires (AR)

(72) Inventor: Andrea Luisa Grun, Buenos Aires (AR)

( * ) Notice: Subject to any disclaimer, the term of this patent is extended or adjusted under 35 U.S.C. 154(b) by 0 days.

(21) Appl. No.: 14/655,000

(22) PCT Filed: Oct. 24, 2013

(86) PCT No.: PCT/IB2013/059631
§ 371 (c)(1),
(2) Date: Jun. 23, 2015

(87) PCT Pub. No.: WO2014/072864
PCT Pub. Date: May 15, 2014

(65) Prior Publication Data

US 2016/0002973 A1 Jan. 7, 2016

(51) Int. Cl.

| | |
|---|---|
| ***A47H 13/00*** | (2006.01) |
| ***E06B 9/01*** | (2006.01) |
| ***E06B 9/06*** | (2006.01) |
| *E06B 9/00* | (2006.01) |

(52) U.S. Cl.
CPC ... *E06B 9/01* (2013.01); *E06B 9/06* (2013.01); *E06B 2009/002* (2013.01); *E06B 2009/015* (2013.01)

(58) Field of Classification Search
CPC E06B 9/01; E06B 2009/002; E06B 2009/015
USPC ..... 160/104, 106, 369, 370, 378, 389, 390, 160/391, 392, 400, 402; 49/50
See application file for complete search history.

(56) References Cited

U.S. PATENT DOCUMENTS

| | | | | |
|---|---|---|---|---|
| 1,635,601 | A | 7/1927 | Ferdinand | |
| 2,136,042 | A | 11/1938 | Cornell | |
| 2,966,206 | A * | 12/1960 | Hartman | 160/402 |
| 3,353,232 | A | 11/1967 | Brownson | |
| 4,127,156 | A | 11/1978 | Brandt | |
| 4,986,389 | A | 1/1991 | Halligan, Sr. et al. | |
| 5,351,739 | A | 10/1994 | Levy | |
| 5,620,036 | A * | 4/1997 | Grous | 160/89 |
| 2004/0159345 | A1 | 8/2004 | Gower | |
| 2011/0154739 | A1 * | 6/2011 | Grun | 49/50 |

FOREIGN PATENT DOCUMENTS

| | | |
|---|---|---|
| AR | 054399 | 6/2007 |
| CN | 2459432 | 11/2001 |

(Continued)

*Primary Examiner* — Jerry Redman
(74) *Attorney, Agent, or Firm* — Defillo & Associates, Inc; Evelyn A Defillo

(57) ABSTRACT

The invention relates to a device comprising protective netting suitable for use as a barrier for any type of opening located at a height. The device uses a set of specially designed aluminum sections that can be produced in series and are easy to handle, as well as comprising mobile anchoring elements that engage with guides provided on the section in order to mount the mesh-type safety net that can be used as a containment barrier, preferably for balconies, windows and staircase, which reduces the risk of falls by children and/or careless people, in a secure, cost-effective and aesthetically pleasing manner.

7 Claims, 6 Drawing Sheets

(56) References Cited

FOREIGN PATENT DOCUMENTS

| | | |
|---|---|---|
| EP | 2182160 | 5/2010 |
| ES | 1056457 | 4/2004 |
| GB | 2376975 | 12/2002 |
| GB | 2378475 | 2/2003 |

* cited by examiner

DEVICE COMPRISING PROTECTIVE NETTING, SUITABLE FOR USE AS A BARRIER FOR ANY TYPE OF OPENING LOCATED AT A HEIGHT

CROSS REFERENCE TO RELATED APPLICATION

This application is a national stage entry of PCT/IB2013/059631 filed Oct. 24, 2013, under the International Convention claiming priority over Argentinean Patent Application No. 20120104211 filed Nov. 9, 2012.

FIELD OF THE INVENTION

The present invention relates to a protective device including a woven mesh or net associated with a number of metal profiles, with special clamping elements preferably applicable to height openings, such as for example, to balconies, terraces, windows, stairs and between floors, which will grant in a safe, economic, and aesthetic way, reduce the risk of falls from all kinds of opening by children and/or careless people, as well as pets, etc.

BACKGROUND OF THE INVENTION

In relation to the prior art, it is known the application of plastic or metallic weaves or plastic and glass plates, over the openings of windows or balconies, all of them in order to prevent that people, particularly children, may fall into the space.

Among the problems and limitations found in the solutions of using plastic and metallic net, is the lack of visibility generated by these materials, and the lack of aesthetics when having elements which are not tensioned all over its entire surface and especially in relation with the efficiency of its system of fixing and installation, insecurity for the low resistance or deficiencies of the anchor used in the mesh or net. In addition, the application of these weaves must be carried out by qualified personnel, since special tools are needed; raising the installation costs of said protection weaves.

In regards to the solutions of clear plastic or glass plates devices, there is first a high cost thereof, to which must be added the limitation in the openings, in order to ensure the proper ventilation of the living spaces and an efficient air flow.

Another closest protection device includes the installing of a net or mesh tightened by means of a rope in the perimeter threaded to the same net or mesh; so once the rope is tightened, that action makes the whole net or mesh also tighten. This rope is attached with ordinary fixing elements (staples, hook screws, etc), and in order to tighten it, a manual force is applied in case of not having any other additional traction element. While it is very important to the type of rope that is used, plus the components thereof, which must be very reliable and of high tenacity.

Some of the drawbacks of this type of application lies in the sum of risk factors such as: highly tightened net or mesh, lack of tension in the rope perimeter of which depends on the safety and efficacy of the entire net, fixing elements failure, whether individually or collectively, aging or oxidation of the anchors, or lack of correct alignment on the anchors that generates an unsatisfactory result.

There is also another device composed of a mesh-like net made up of threads forming a large quantity of squares, and preferably "L" profiles to the opening, by being inserted in each of the squares on the edge of the net mesh type net, a tensioning element of the wire type bent in the substantial form of a "U" used as a key, to be introduced into the pre-existing holes along mentioned fastening profiles, in order to facilitate the anchorage of the aforementioned mesh type net. Aluminum profiles can be selected from raw aluminum, anodized aluminum and/or oven painted aluminum.

One of the drawbacks of using the anchoring and tightening elements of a wire type and metal profiles are the risks of hurting, puncturing, or scraping the children or adults who have access to these facilities.

Besides the risk of sharp edges, which might damage more the users, as well as the net.

Also it is known a device with network protection, belonging to the same inventor in the EP 2182160 A2 publication, where it contains a net type mesh which is preferably in white or transparent material composed of wires made of tanze threads defining mono-filaments and multifilament woven, knotless mesh "raschel" type of high tenacity and resistance, comprising a plurality of rhombuses, which is placed on all of the open surfaces, which it is intended to protect. The aforementioned net does not require cleaning or painting and provides a view through the same; achieving in addition not to alter the facades of the apartment or the house, or decrease the luminosity and ventilation of the environment.

The strength thereof is guaranteed by the absolute discontinuity of its fabric, such that a possible rupture is interrupted immediately by the thermo sealed knot or thermo fused knot, allowing an easy repair.

The installation is simple, thanks to the special design of the profile, using the necessary amount required according to the dimensions of the perimeter of the opening to protect and the mobile clamping elements, that cooperate in this profile and are fixed to the structure (floors/slabs/lintels, etc.) using secure bits to achieve a perfect mounting of the net type mesh.

The net or mesh is anchored to the profile in a safe manner on any position required by the site to be covered, thanks to the design of the clamping devices of an anchor type that by its morphology admits being applied in all positions and possible directions, ensuring in all cases that the net cannot escape in any way.

The "clamping elements" include at least one sector which allows to drill the profile where appropriate according to the requirements or limitations of the surface to which you must adhere.

SUMMARY OF THE INVENTION

The proposed device has the following advantages:

1) has profiles made of a metallic material, preferably aluminum, giving a condition of mass production in series and easy handling.

2) the profiles are interchangeable, installed in any position, forming different configurations depending on the surface to protect, avoiding by their morphology that the net slips and can break away.

3) the easy installation by having fewer fixations, by the number of pieces to be used for the clamping of the net, and by being independent from the profile, there is not a limitation achieving an effect of detaching them in their assembly.

4) the economy of the raw materials, production, and logistics of the product by marketing it as a "Kit" of in situ mount installation.

5) the easy removal in case of emergencies, thus facilitating the access to extension ladders by firefighters and/or paramedics.

6) offering the broader mechanical resistance to the net, being the net distributing its force evenly, completely, and radially.

7) divergent forces, the profile is attached to the opening with screws regardless of the effort to tie parts taken by the net.

8) does not include a reverse side, from any angle, the termination is neat and well finished.

The problem raised has given cause to think that the solution has to do with the provision of a "device with a safety net suitable as a barrier for all kinds of openings". Also the same inventor known in the state of the art for several devices serving the same purpose; published in patent documents which deserve to be commented on by its importance, among which we can mention: AR 054399 A4; ES 1056457U; U.S. Pat. No. 1,635,601A; U.S. Pat. No. 4,986,389; U.S. Pat. No. 3,353,232 A and U.S. Pat. No. 4,127,156 A.

In conclusion, the merit of the improvement on other devices that serve the purpose is that it is at least a metallic profile, preferably of aluminum, which includes a guide to accommodate movable clamping elements made of a polyamide material, which represents an enormous improvement in the time for the installer and allows the use of nets of different sizes, since it can be run to the dimensions of the rhombus; on the other hand the clamping element, may be removed or added as needed since it has a turning radius (the part) and can remove or place if necessary.

Also with the previous mentioned profile from the same inventor (EP 2182160 A2), there should be placed 4 screws, each 0.50 cm, and with the improvement of the present invention only uses 6 each at 2 meters, which significantly reduces the time of installation by the operator.

Also, the aluminum of the profiles are also selected from raw aluminum, anodized aluminum, or oven painted aluminum.

BRIEF DESCRIPTION OF THE DRAWINGS

In order to make more understandable the object of the invention, it has been illustrated with three schematic figures, in its preferable embodiment, which assume a character of a demonstrative example; in them.

DETAILED DESCRIPTION OF THE INVENTION

In all the figures, the same reference numbers indicate the same or corresponding elements, they are:

1. Opening frame.
2. Metal profile.
3. Top section of the profile.
4. Bottom section of the profile.
5. Flat base.
6. Longitudinal channel arranged in the flat base.
7. Folded tabs.
8. Central axial opening.
9. Clamping element for the fastening of the net or mesh (12).
10. Rectangular base platform.
11. Slot's socket tab.
12. Net or mesh, rhombus type.
13. Holes made by the installer when installing for mounting the frame clamping elements such as screw—dowels not shown.
14. A crimp.
15. Fin.
16. Arc Part.
17. Accommodation notch for the net.
18. Longitudinal nerves and laterally emerging from the platform (10).
19. Rounded end of the platform (10).
20. Longitudinal nerves in the bottom section (4) of the profile (2).

Figure 1:
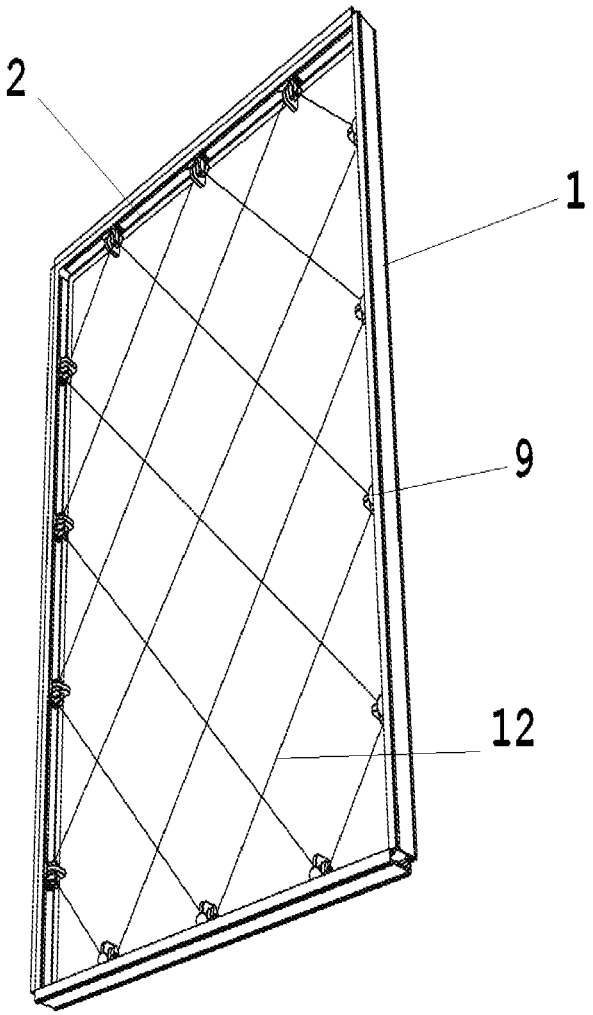
FIG. 1, shows a perspective view of the framework of an opening which has been applied the protection net device of the invention.

Said FIG. 1, shows the frame 1 which holds the net type mesh 12, through the use of a set of profiles 2, being long-form mono-pieces, which has in its top section 3 two tabs 7, continuously extending around the contour of the profile 2, both laterally inward projecting and facing each other and at the bottom section contains a flat base 5 forming a solid bottom and defining a central axial opening 8; the solid bottom has at least one longitudinal channel 6 associated with the tabs 7 defined internal guides cooperating with multiple independent clamping elements 9, which contains a crimp 14 at its apex of each rhombus of this net.

Figure 2:
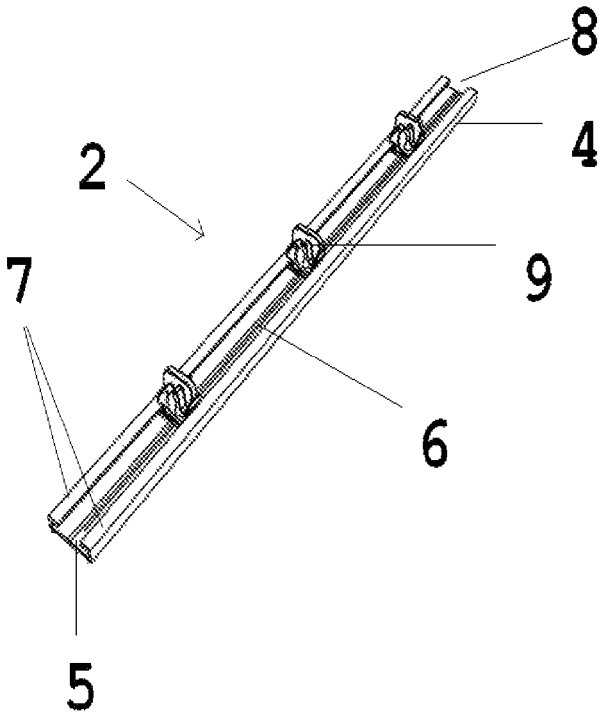
FIG. 2, illustrates a perspective view of the metal profile with clamping elements incorporated into the central axial opening of this profile.
Figure 3:
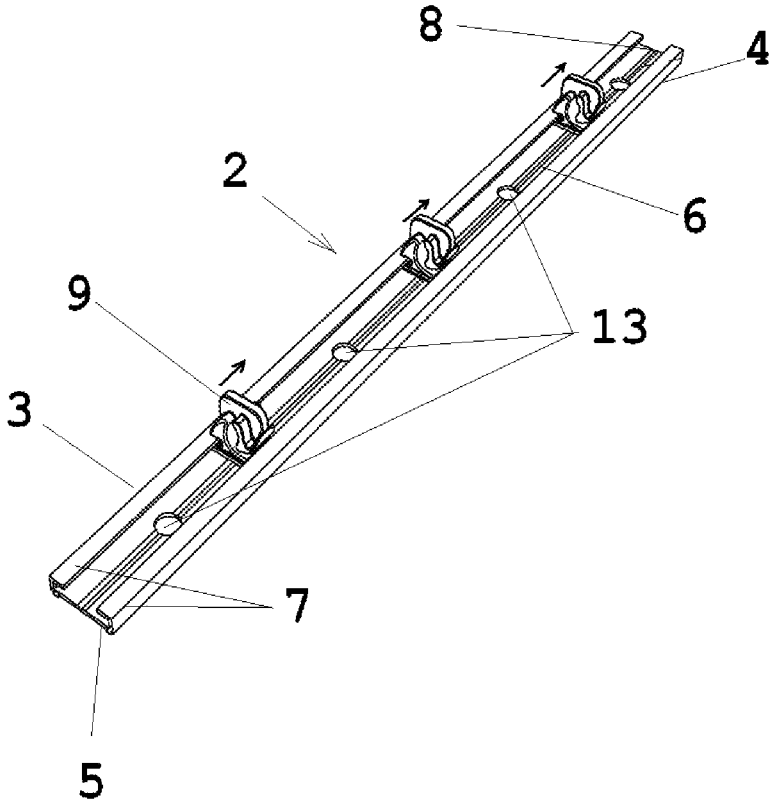
FIG. 3, shows a perspective view of the metal profile with the moving parts of the clamping element incorporated and with holes made by the installer for its subsequent installation.

FIGS. 2 and 3, clearly show the characteristics of the profiles 2 where they are defined by long-form mono-pieces, on which its solid bottom 4 has at least two longitudinal ribs 20 with a thickness which is intended to hide the imperfections of the termination on the walls causing a minimum shade that conceals the undulations of the fine plaster.

Figure 4:
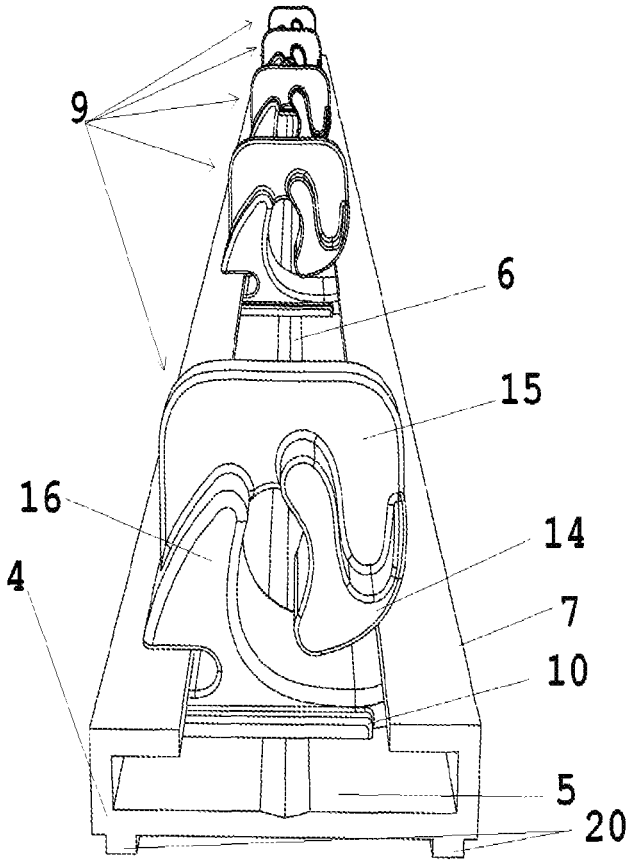
FIG. 4, illustrates a perspective side view of the metal profile with parts mobile for the mooring of network or mesh.
Figure 5:
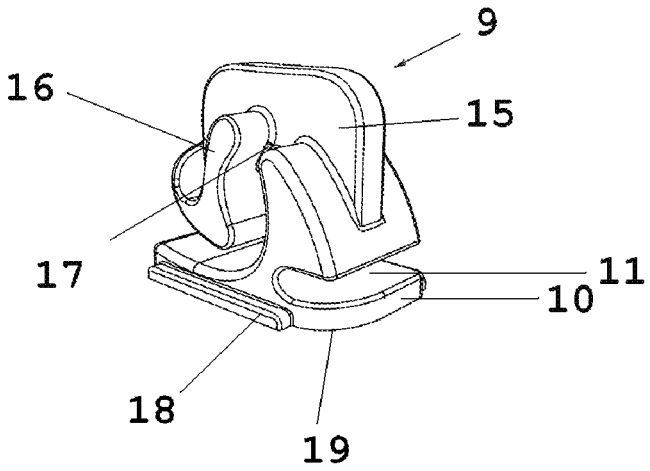
FIGS. 5 and 6, are positional and views in perspective of the piece for the mooring of the network or mesh.
Figure 6:
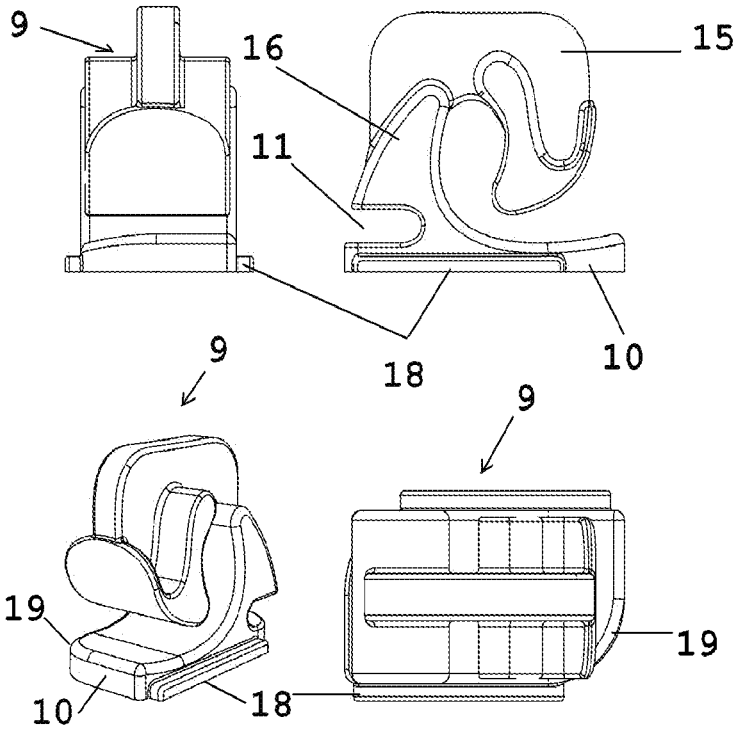

FIGS. 4 and 5, show the clamping element 9 for the fastening of the net or mesh 12, this element contains a rectangular base platform 10, with one rounded end defining a turning radius that is intended for the possibility of removing or adding the piece in situ, integrate with a crimp 14 of curved profile with respect to this base.

The clamping elements basically include a rectangular base platform 10, connected one side to a crimp 14 which includes a projection morphologically curve with thickness and width, and from that side continuously arches until the proximity of the opposite side of the rectangular base platform 10 and forming with the free end and with respect to the platform a separation that allows access to the inside of such arc part 16.

Also said crimp 14 includes also a flap 15 arranged on the outer side of the arched part, of length equivalent to the corresponding side of the platform; and the arch part 16 on its top end presents two notches 17 serving as lodging channels to housing the net or mesh 12 opposite separated by the thickness of the fin 15.

It is a very important technical feature that the clamping element 9 of the protective net or mesh are independent, and work in solidarity through the longitudinal nerves and laterally emergent of the platform 10, when attached to the guides of the metallic profile(s).

We leave record that described and illustrated is only a preferred way of preparation of the present invention and that it will be deemed included within its sphere, all other realization that not apart from the claims that then develop and which, all relating to position, location and/or form term shall be construed when the device claiming in normal position and/or adapted.

Having described and represented the nature and scope of the invention and the way it has to be realized, is declared claim of exclusive rights and ownership.

The invention claimed is:

1. A device including a protection net that serves as a barrier for openings comprising:

an opening frame;

metallic profiles, each metallic profile having an elongated shape and including a top section, a longitudinal contour, and a bottom section;

a net attached to the opening frame by using the metallic profiles, the net is made of transparent or white thread, the net forming a discontinuous weaving producing a plurality of rhombuses within the opening frame;

wherein the top section of each metallic profile includes a first tab and a second tab on the top section, the tabs extend through the entire contour of the profile and project laterally inward, facing each other, and defining a central axial opening;

wherein the bottom section of each metallic profile a flat base forming a solid bottom and defining a central axis opening, and at least one longitudinal channel associated with the tabs defining internal guides;

a plurality of clamping elements placed on the central axial opening, the plurality of clamping elements slide through the central axial opening;

each clamping elements include a crimp having a curved shape, each crimp is secured to a vertex of each rhombus.

2. The device according to claim 1, wherein each clamping element includes a rectangular base platform connected to a side of the crimp and includes a projection having a curved shape.

3. The device according to claim 2, wherein the rectangular base has a rounded end.

4. The device according to claim 2, wherein the crimp further comprises a flap located on an outer side of said curved shape, the flap has a length equivalent to a corresponding side of the rectangular base platform; and the curved shape has a top end including two notches which houses the net.

5. The device according to claim 2, wherein each clamping element is made of a polyamide.

6. The device according to claim 1, wherein the metallic profiles are made of aluminum, the aluminum is selected from the group consisting of a raw aluminum, an anodized aluminum, and an oven painted aluminum.

7. The device according to claim 1, wherein the flat base contains pre-made holes.

* * * * *